US010199009B2

(12) United States Patent
He et al.

(10) Patent No.: US 10,199,009 B2
(45) Date of Patent: Feb. 5, 2019

(54) DISPLAY ADJUSTING SYSTEM AND DISPLAY ADJUSTING METHOD

(71) Applicants: BOE Technology Group Co., Ltd., Beijing (CN); Beijing BOE Optoelectronics Technology Co., Ltd., Beijing (CN)

(72) Inventors: Quanhua He, Beijing (CN); Lingyun Shi, Beijing (CN); Hao Zhang, Beijing (CN); Zijiao Xue, Beijing (CN); Wei Wang, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 0 days.

(21) Appl. No.: 15/325,128

(22) PCT Filed: Dec. 24, 2015

(86) PCT No.: PCT/CN2015/098705

§ 371 (c)(1),
(2) Date: Jan. 10, 2017

(87) PCT Pub. No.: WO2017/020504

PCT Pub. Date: Feb. 9, 2017

(65) Prior Publication Data

US 2017/0200427 A1 Jul. 13, 2017

(30) Foreign Application Priority Data

Aug. 6, 2015 (CN) ..... 2015 1 0479020

(51) Int. Cl.
*G09G 5/14* (2006.01)
*G09G 5/373* (2006.01)
*G09G 5/00* (2006.01)

(52) U.S. Cl.
CPC ..... *G09G 5/006* (2013.01); *G09G 5/00* (2013.01); *G09G 2320/068* (2013.01);
(Continued)

(58) Field of Classification Search
None
See application file for complete search history.

(56) References Cited

U.S. PATENT DOCUMENTS

2005/0229200 A1 10/2005 Kirkland et al.
2009/0315924 A1* 12/2009 Chou ..... G09G 5/00 345/698

(Continued)

FOREIGN PATENT DOCUMENTS

CN 101609659 12/2009
CN 103050107 4/2013

(Continued)

OTHER PUBLICATIONS

International Search Report and Written Opinion of International Application No. PCT/CN2015/098705, dated May 5, 2016, 9 pages.

(Continued)

*Primary Examiner* — Martin Mushambo
(74) *Attorney, Agent, or Firm* — Westman, Champlin & Koehler, P.A.

(57) ABSTRACT

A display adjusting system and a display adjusting method thereof are provided. These technical solutions relate to the field of display technology, may reduce power consumption of a portable electronic device, and may improve endurance ability of the portable electronic device. The display adjusting system comprises: a distance measuring module configured to measure a viewing distance, the viewing distance being a vertical distance from a viewing point to a display screen; and a resolution adjusting unit connected with the distance measuring module, the resolution adjusting unit being configured to set a matching resolution based on the measured viewing distance and a resolution power of a human's eye under the measured viewing distance and to adjust a resolution of the display screen to the matching (Continued)

resolution. The display adjusting system may be used to adjust a resolution of a display screen.

14 Claims, 2 Drawing Sheets

(52) U.S. Cl.
CPC . *G09G 2320/0626* (2013.01); *G09G 2320/08* (2013.01); *G09G 2330/021* (2013.01); *G09G 2340/0407* (2013.01); *G09G 2340/14* (2013.01); *G09G 2354/00* (2013.01)

(56) References Cited

U.S. PATENT DOCUMENTS

| | | | | |
|---|---|---|---|---|
| 2015/0179149 | A1 | 6/2015 | Park | |
| 2016/0286626 | A1* | 9/2016 | Kano | H05B 37/0227 |

FOREIGN PATENT DOCUMENTS

| | | | |
|---|---|---|---|
| CN | 103578430 | | 2/2014 |
| CN | 104076879 | A | 10/2014 |
| CN | 104320714 | A | 1/2015 |
| CN | 104361849 | A | 2/2015 |
| CN | 105139791 | A | 12/2015 |

OTHER PUBLICATIONS

English translation of Box No. V of the Written Opinion for the International Searching Authority for International Application No. PCT/CN2015/098705, 1 pages.

Second Office Action from Chinese Patent Application No. 201510479020.6, dated Sep. 30, 2017, 13 pages.

First Office Action from Chinese Patent Application No. 201510479020.6, dated Apr. 24, 2017.

* cited by examiner

DISPLAY ADJUSTING SYSTEM AND DISPLAY ADJUSTING METHOD

CROSS-REFERENCE TO RELATED APPLICATIONS

This application is a Section 371 National Stage Application of International Application No. PCT/CN2015/098705, filed on 24 Dec. 2015, entitled "DISPLAY ADJUSTING SYSTEM AND DISPLAY ADJUSTING METHOD", which claims priority to Chinese Application No. 201510479020.6 filed on 6 Aug. 2015, incorporated herein by reference in their entirety.

TECHNICAL FIELD

Embodiments of the invention relate to the field of display technology, and especially to a display adjusting system and a display adjusting method.

BACKGROUND

Currently, portable electronic devices, such as smart phones, tablet computers and the like, have become daily used electronic devices for people, such as office workers and students, and portable electronic devices play a more and more important role in people's daily lives.

Endurance ability is a key performance parameter of a portable electronic device. Endurance ability means a standby time during which the device can operate normally, and endurance ability of a portable electronic device is relevant to power consumption of the device itself and a capacity of its battery. With the same battery capacity, the lower a power consumption of a device is, the stronger endurance ability will be; and with the same power consumption of the device, the larger a battery capacity is, the stronger endurance ability will be.

A large amount of data transmissions and calculations are performed during operations of a touch screen of a portable electronic device and various applications installed therein, such as audio display, video display, games, navigations and the like, which lead to large power consumption and bad endurance ability of the portable electronic device at present.

SUMMARY

In order to overcome at least one aspect of the disadvantages in prior arts, a display adjusting system and a display adjusting method for display is provided in an embodiment of the invention, to lower power consumption and improve endurance ability of the portable electronic device.

To achieve the above objective, technical solutions provided in embodiments of the invention are as follows.

In a first aspect of the disclosure, there is provided a display adjusting system, which may comprise: a distance measuring module configured to measure a viewing distance, the viewing distance being a vertical distance from a viewing point to a display screen; and a resolution adjusting unit connected with the distance measuring module, the resolution adjusting unit being configured to set a matching resolution based on the measured viewing distance and a resolution power of a human's eye under the measured viewing distance and to adjust a resolution of the display screen to the matching resolution.

The above display adjusting system comprises the distance measuring module and the and the resolution adjusting unit, the distance measuring module is configured to measure the viewing distance, and the resolution adjusting unit is configured to set a matching resolution based on the measured viewing distance and a resolution power of a human's eye under the measured viewing distance and to adjust a resolution of the display screen to the matching resolution, such that a function of adjusting the resolution of the display screen based on the vertical distance from the viewing point to the display screen (i.e., the viewing distance) is achieved and the problem of wasting the resolution of the display screen when a viewing point is relatively far away from the display screen due to constant resolution of the display screen may be overcome, thus, power consumption of the display screen can be saved, and endurance ability of batteries of portable electrical devices may be improved.

Based on the above display adjusting system, optionally, the distance measuring module may comprise: a distance measuring device configured to measure a linear distance from the viewing point to the display screen; and a viewing distance calculating unit connected with the distance measuring device and configured to calculate the viewing distance based on the measured linear distance from the viewing point to the display screen.

Optionally, the display adjusting system may further comprise: a viewing angle calculating unit connected with the distance measuring device and configured to calculate a viewing angle based on the measured linear distance from the viewing point to the display screen; and a brightness adjusting unit connected with the viewing angle calculating unit, the brightness adjusting unit being configured to set a matching brightness based on the calculated viewing angle and a brightness needed for the human's eye to clearly view a displayed image at the calculated viewing angle and to adjust a brightness of the display screen to the matching brightness.

Optionally, the distance measuring device may comprise a plurality of sensing signal generators and a plurality of sensing signal receivers, the sensing signal generators and the sensing signal receivers are arranged in one-to-one correspondence, and sensing signals sent by respective sensing signal generators are different from each other.

Optionally, the sensing signal generators and the sensing signal receivers may be disposed on the display screen, and each of the sensing signal generators is integrated with or disposed adjacent to a corresponding one of the sensing signal receivers.

Optionally, the distance measuring device may further comprise glasses, the sensing signal generators are disposed on the glasses and the sensing signal receivers are disposed on the display screen; alternatively, the sensing signal generators are disposed on the display screen and the sensing signal receivers are disposed on the glasses.

Optionally, the distance measuring device may comprise an acoustic distance measuring device or an infrared distance measuring device.

In a second aspect of the present disclosure, there is provided a display adjusting method for the display adjusting system above, the display adjusting method may comprise: measuring a viewing distance; and setting a matching resolution based on the measured viewing distance and a resolution power of the human's eye under the measured viewing distance, and adjusting the resolution of the display screen to the matching resolution.

The above display adjusting method has the same beneficial effects as those of the display adjusting system, which is not repeated herein.

Based on the display adjusting method, optionally, the matching resolution may be larger than or equal to the resolution power of the eye under the measured viewing distance.

Optionally, measuring the viewing distance may comprise: measuring a linear distance from a viewing point to the display screen; and calculating the viewing distance based on the measured linear distance from the viewing point to the display screen.

Optionally, the display adjusting method may further comprise: calculating a viewing angle based on the measured linear distance from the viewing point to the display screen; and setting a matching brightness based on the calculated viewing angle and a brightness needed for the eye to clearly view a displayed image at the calculated viewing angle, and adjusting a brightness of the display screen to the matching brightness.

Optionally, the matching brightness may be larger than or equal to the brightness needed for the eye to clearly view the displayed image at the calculated viewing angle.

Optionally, the distance measuring device of the display adjusting system may comprise a plurality of sensing signal generators and a plurality of sensing signal receivers, the sensing signal generators and the sensing signal receivers are arranged in one-to-one correspondence, and measuring the linear distance from the viewing point to the display screen may comprise: generating and sending a sensing signal by the sensing signal generators; receiving the sensing signal by the sensing signal receivers; and calculating the linear distance from the viewing point to the display screen based on a sending time and a receiving time of the sensing signal and a transmission speed of the sensing signal.

Optionally, the sensing signal generators and the sensing signal receivers may all be disposed on the display screen, each of the sensing signal generators is integrated with or disposed adjacent to a corresponding one of the sensing signal receivers, and calculating the linear distance from the viewing point to the display screen based on a sending time and a receiving time of the sensing signal and a transmission speed of the sensing signal may comprise: calculating a difference between the sending time and the receiving time of the sensing signal and obtaining a duration time of transmission of the sensing signal; multiplying the duration time by the transmission speed of the sensing signal to obtain a transmission distance of the sensing signal; and dividing the transmission distance by two to obtain the linear distance from the viewing point to the display screen.

Optionally, the distance measuring device may further comprise glasses, the sensing signal generators and the sensing signal receivers are disposed on the glasses and the display screen respectively, and calculating the linear distance from the viewing point to the display screen based on a sending time and a receiving time of the sensing signal and a transmission speed of the sensing signal may comprise: calculating a difference between the sending time and the receiving time of the sensing signal and obtaining a duration time of transmission of the sensing signal; and multiplying the duration time by the transmission speed of the sensing signal to obtain the linear distance from the viewing point to the display screen.

BRIEF DESCRIPTION OF THE DRAWINGS

In order to describe technical solutions provided in embodiments of the invention and in prior arts, the drawings that are used to illustrate the technical solutions in embodiments of the invention and in prior arts will be briefly introduced. Apparently, these appended drawings only illustrate some embodiments of the invention, and drawings of other embodiments can be obtained by a person of ordinary skill without a creative work based on the appended drawings

LIST OF REFERENCE NUMERALS

100: display adjusting system;
10: distance measuring module;
1: distance measuring device;
11: sensing signal generator;
12: sensing signal receiver;
2: viewing distance calculating unit;
3: resolution adjusting unit;
4: viewing angle calculating unit;
5: brightness adjusting unit;
200: display screen;
300: glasses.

DETAILED DESCRIPTION OF PREFERRED EMBODIMENTS

As described in the Background portion, existing portable electronic devices have larger power consumption, which leads to bad endurance ability. Through a large amount of researches and experiments, inventors of the present application found that one reason that leads to the above disadvantage lies in that: when human's eyes are watching an image displayed on a display screen, a resolution power of human's eyes increases as a view distance decreases, where resolution power of an eye can be used to express an ability to distinguish details of the image, and a viewing distance refers to a vertical distance between the eye and the display screen. In other words, when a viewing distance is relatively large, a resolution power of an eye is relatively low; and when a viewing distance is relatively small, a resolution power of an eye is relatively high. In prior arts, a resolution of a display screen usually does not change during displaying an image, which may leads to a mismatch between the resolution of the display screen and a resolution power of an eye. Specifically, the mismatch may be as follows: when a viewing distance is relatively small, a resolution power of an eye is higher than a resolution of the display screen, which leads to a feel of rough image when the image is being watched by an eye; when a viewing distance is relatively large, a resolution power of an eye is lower than a resolution of the display screen, the eye cannot observe some details that are fine during watching the image, leading to a waste of resolution of the display screen. The large a resolution of a display screen is, the more data transmissions and calculations are, and the more power consumption is. Therefore, when a view distance is relatively large, a waste of resolution of a display screen leads to unnecessary waste of electrical power, thereby adversely affecting endurance ability of a portable electronic device.

Figure 1:
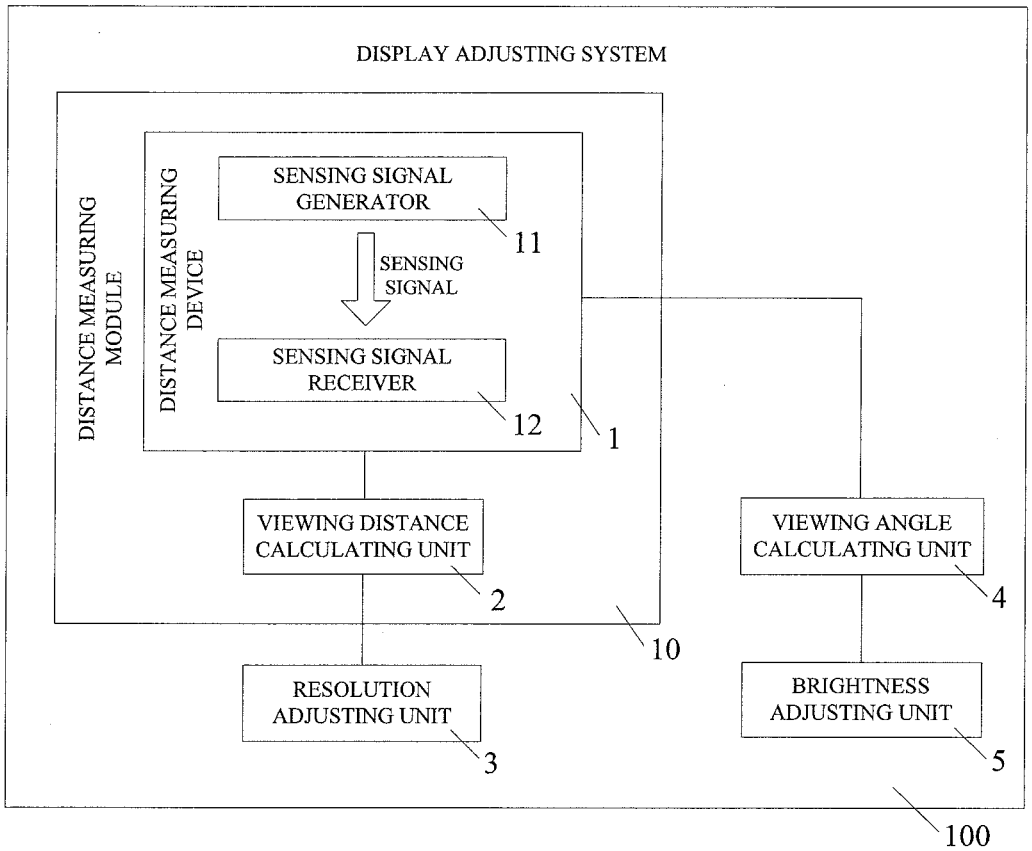
FIG. 1 is a schematic block diagram showing a structure of a display adjusting system according to an embodiment of the invention.

Based on the above, a display adjusting system is provided according to an embodiment of the invention. As shown in FIG. 1, a display adjusting system 100 includes a distance measuring module 10 and a resolution adjusting unit 3 connected with the distance measuring module 10. The distance measuring module 10 is configured to measure a viewing distance; the resolution adjusting unit 3 is configured to set a matching resolution based on the measured viewing distance and a resolution power of an eye under the measured viewing distance, such that the resolution of the display screen is adjusted to the matching resolution.

To be noted that, the viewing distance means a vertical distance from a viewing point to the display screen.

In accordance with the display adjusting system, an embodiment of the invention provides a display adjusting method, which may be applied to the display adjusting system. The display adjusting method includes the following steps of:

step S1: measuring a viewing distance;

step S2: setting a matching resolution based on the measured viewing distance and a resolution power of the eye under the measured viewing distance, and adjusting the resolution of the display screen to the matching resolution.

With the above display adjusting system and the display adjusting method, a function of adjusting a resolution of a display screen based on a viewing distance can be achieved, such that the resolution of the display screen is close to or equal to the resolution power of human's eye, the problem of wasting the resolution of the display screen when a viewing point is relatively far away from the display screen due to constant resolution of the display screen, the amount of data processing, transmissions and calculations needed under a relatively large viewing distance can be decreased, power consumption of the display screen can be saved, and endurance ability of batteries of portable electrical devices may be improved.

Moreover, since the resolution of the display screen can vary as the viewing distance varies, the resolution of the display screen may be always near or equal to the resolution power of a human's eye, such that when a user watches the display screen, display performance will not be adversely affected.

Further, with the above technical solutions, when the viewing distance is relatively small, the resolution of the display screen may be near or equal to the resolution power of a human's eye, such that the problem of a feel of rough image due to smaller resolution of the display screen than the resolution power of the eye can be avoided, the resolution of the display screen may meet the requirement of the resolution power of the eye, the user can observe fine details of the image, and user experience may be improved.

In the display adjusting system and the display adjusting method, the step of adjusting the resolution of the display screen to a matching resolution can be explained as follows. Assuming that an original viewing distance is A, each of a resolution of a display screen and a resolution power of a human's eye is B, at this situation, the resolution of the display screen is not wasted, and an optimal display performance with respect to the resolution power of the eye is achieved. After the viewing distance has changed, if the measured viewing distance is larger than A, the resolution power of the eye is decreased, and at this circumstance, the resolution of the display screen may need to be decreased to avoid a waste of the resolution of the display screen, and the decreased resolution of the display screen is determined as the matching resolution; if the measured viewing distance is smaller than A, the resolution power of the eye is increased, and at this circumstance, the resolution of the display screen may need to be increased to avoid a feel of rough image when viewing the display screen, and the increased resolution of the display screen is determined as the matching resolution.

For example, if the viewing distance is reduced to 30 cm, the resolution of the display screen may be increased to 300 PPI (Pixels Per Inch); if the viewing distance is further reduced to 20 CM, the resolution of the display screen may be increased to 400 PPI; when the viewing distance is extremely small, the resolution of the display screen may be increased to a maximum value of the resolution of the display screen.

In the embodiment, the matching resolution should be set to be near to (either slight larger or slightly smaller is acceptable) or equal to the resolution power of the eye under the measured viewing distance, so as to ensure a good viewing effect; preferably, the matching resolution should be set to be larger than or equal to the resolution power of the eye under the measured viewing distance, so as to completely avoid a feel of rough image caused by the resolution of the display device being smaller than the resolution power of the eye when viewing the displayed image; more preferably, the matching resolution should be set to be equal to the resolution power of the eye under the measured viewing distance, such that viewing effect will not be affected at all and a waste of resolution of the display screen can be avoided.

Referring back to FIG. 1, the distance measuring module 10 of the display adjusting system 100 may specifically include a distance measuring device 1 and a viewing distance calculating unit 2 connected with the distance measuring device 1. The distance measuring device 1 is configured to measure a linear distance from the viewing point to the display screen; the viewing distance calculating unit 2 is configured to calculate the viewing distance based on the measured linear distance from the viewing point to the display screen. To be noted, the resolution adjusting unit 3 may be connected with the viewing distance calculating unit 2.

Moreover, the linear distance from the viewing point to the display screen refers to a linear distance from the viewing point to a certain point on the display screen.

In accordance with the display adjusting system in which the distance measuring module 10 includes the distance measuring device 1 and the viewing distance calculating unit 2, the step S1 of the display adjusting method according to the embodiment of the invention, i.e., measuring the viewing distance, may further include the following steps of:

step S11: measuring the linear distance from the viewing point to the display screen; and step S12: calculating the viewing distance based on the measured linear distance from the viewing point to the display screen.

Based on the technical solution that the distance measuring module 10 of the display adjusting system 100 includes the distance measuring device 1 and the viewing distance calculating unit 2, and referring again to FIG. 1, the display adjusting system according to the embodiment of invention may also include: a viewing angle calculating unit 4 and a brightness adjusting unit 5, where the viewing angle calculating unit 4 is connected with the distance measuring device 1, and the brightness adjusting unit 5 is connected with the viewing angle calculating unit 4. The viewing angle calculating unit 4 is configured to calculate a viewing angle based on the measured linear distance from the viewing point to the display screen; the brightness adjusting unit 5 is configured to set a matching brightness based on the calculated viewing angle and a brightness needed for a human's eye to clearly watch a displayed image at the calculated viewing angle and to adjust a brightness of the display screen to the matching brightness.

To be noted, the view angle refers to an included angle between a line of sight and a direction vertical to the display screen.

In accordance with the display adjusting system further provided with the viewing angle calculating unit 4 and the brightness adjusting unit 5, the display adjusting method according to an embodiment further includes:

calculating the viewing angle based on the measured linear distance from the viewing point to the display screen; and setting a matching brightness based on the calculated viewing angle and the brightness needed for a human's eye to clearly watch the displayed image at the calculated viewing angle, and adjusting the brightness of the display screen to the matching brightness.

With the viewing angle calculating unit 4 being configured to calculate the viewing angle based on the measured linear distance from the viewing point to the display screen and then the brightness adjusting unit 5 being configured to set the matching brightness based on the calculated viewing angle and the brightness needed for a human's eye to clearly watch the displayed image at the calculated viewing angle and set a brightness of the display screen to the matching brightness, a function of adjusting a brightness of a display device based on a viewing angle can be achieved, such that the brightness of the display device is near to or equal to the brightness needed for a human' eye to clearly watch the displayed image, and the problem that a user cannot clearly watch displayed images due to relatively large viewing angle and the brightness of the display which cannot reach the brightness needed for a human's eye to clearly watch displayed images is avoided, so that even if the viewing angle is relatively large, the user still can clearly watch displayed images; further, the problem of unnecessary power waste due to relatively small viewing angle and the brightness of the display having gone beyond the brightness needed for a human's eye to clearly watch displayed images is also avoided, so that power consumption of the display screen can be saved, and endurance ability of a portable electronic device may be improved.

In the above technical solution of adjusting brightness of a display screen according to viewing angle, the step of setting the brightness of the display screen to the matching brightness can be explained as follows. Assuming that an original viewing angle is a, a brightness of a display screen and a brightness needed for a human's eye to clearly watch a displayed image is X, and at this situation, the brightness of the display screen is not wasted, and a user can just clearly watch the displayed image. After the viewing angle has changed, if the measured viewing angle is larger than a, then the brightness needed for a human's eye to clearly watch the displayed image is increased, at this circumstance, the brightness of the display screen may need to be increased such that the user can clearly watch the displayed image, and the increased brightness of the display screen is determined as the matching brightness; if the measured viewing angle is less than a, then the brightness needed for a human's eye to clearly watch the displayed image is decreased, at this circumstance, the brightness of the display screen may need to be decreased so as to avoid a waste of brightness of the display screen, and the decreased brightness of the display screen is determined as the matching brightness.

For example, when a human's eye is located at a centre of a display screen, the brightness needed to clearly watch a displayed image is the lowest, and at this circumstance, the brightness of the display screen may be set to be its lowest; when a human's eye is watching slantways, brightness of the display screen may be increased such that the user can clearly watch a displayed image and degree of comfort of watching slantways can be improved.

In the embodiment, the matching brightness should be set to be near to (either slight larger or slightly smaller is acceptable) or equal to the brightness needed for a human's eye to clearly watch a displayed image under the measured viewing angle, so as to ensure that the user can clearly watch the displayed image; preferably, the matching brightness is set to be larger than or equal to the brightness needed for the human's eye to clearly watch the displayed image under the measured viewing angle, so as to ensure that the user can clearly watch the displayed image; more preferably, the matching brightness is set to be equal to the brightness needed for the human's eye to clearly watch the displayed image under the measured viewing angle, the user can be ensured to clearly watch the displayed image and a waste of brightness of the display screen can be avoided.

Referring back to FIG. 1, the distance measuring device 1 of the display adjusting system according to an embodiment may include a plurality of sensing signal generators 11 and a plurality of sensing signal receivers 12 corresponding to the sensing signal generators 11 in one-to-one correspondence, and sensing signals sent by respective sensing signal generators 11 are different from each other.

In this condition, in the display adjusting method, step S11 of measuring the linear distance from the viewing point to the display screen may include:

S111: generating and sending a sensing signal by each of the sensing signal generators;

S112: receiving the sensing signal by a corresponding one of the sensing signal receivers; and S113: calculating the linear distance from the viewing point to the display screen based on a sending time and a receiving time of the sensing signal and a transmission speed of sensing signal.

To be noted, the steps of S111 to S113 is provided with respect to one pair of sensing signal generator 11 and sensing signal receiver 12 and the sensing signal transmitted therebetween. Since a plurality of sensing signals are sent and received, and each sensing signal corresponds to a respective sending time and a respective receiving time, respective linear distances from the viewing point to the display screen can be obtained by the steps S111 to S113.

The embodiment of the invention is not limited to specific configurations of the sensing signal generators 11 and the sensing signal receivers 12 of the distance measuring device 1. Several exemplary configurations are provided as follows.

Figure 2:
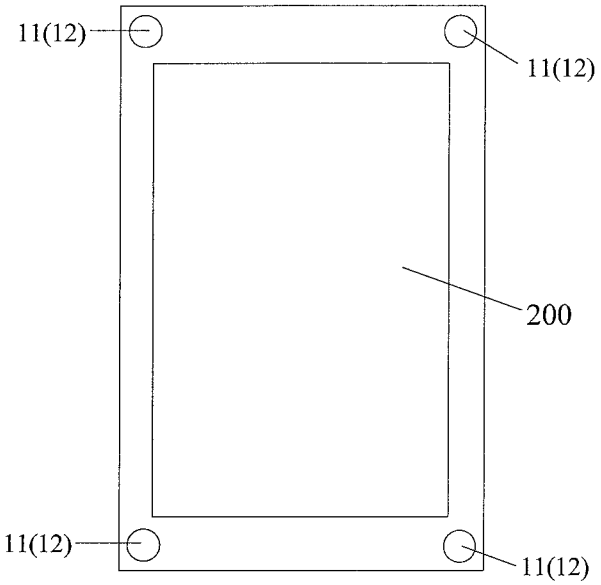
FIG. 2 is a schematic diagram showing a first configuration of a distance measuring device in a display adjusting system according to an embodiment of the invention.

Please refer to FIG. 2, the sensing signal generators 11 and the sensing signal receivers 12 may all disposed in or on the display screen 200, a pair of corresponding sensing signal generator 11 and sensing signal receiver 12 may be integrated together or disposed adjacent to each other. During transmission of the sensing signal sent by the sensing signal generator 11, the sensing signal will be reflected at the viewing point by an obstacle (such as, a human's face) and back to the display screen, and is received by the sensing signal receiver 12 integrated together with or disposed adjacent to the sensing signal generator 11.

In implementations of the embodiment of the invention, the sensing signal generators 11 may be disposed uniformly or symmetrically on side frames of the display screen 200, and the sensing signal receivers 12 may be disposed in a manner similar to the sensing signal generators 11, such that measurements of linear distances between the viewing point and the display screen 200 may cover the whole display screen 200 as much as possible, and comprehensiveness of data of the measured linear distances can be improved, thus, accuracy of the calculation of the viewing distance based on the measured linear distances may be improved. More specifically, as shown in FIG. 2, there may be four sensing signal generators 11 disposed at four corners of the display screen 200 respectively, and there may be four sensing signal receivers 12 integrated with or disposed adjacent to the four sensing signal generators 11 respectively.

Regarding the configuration that all the sensing signal generators 11 and the sensing signal receivers 12 are disposed on the display screen 200, the process of calculating the linear distance from the viewing point to the display screen 200 by the distance measuring module 10, i.e., the step S113, may include:

step S1131: calculating a difference between the sending time and the receiving time of the sensing signal and obtaining a duration time of transmission of the sensing signal;

step S1132: multiplying the duration time by the transmission speed of the sensing signal to obtain a transmission distance of the sensing signal, the transmission distance being a total travel distance of the sensing signal from the viewing point to the display screen 200 and back to the viewing point; and step S1133: dividing the transmission distance by two, so as to obtain the linear distance from the viewing point to the display screen 200.

To be noted, the linear distance from the viewing point to the display screen 200 calculated through steps S1131 to S1133 is in fact a linear distance from the viewing point to the sensing signal generator 11 disposed on the display screen 200 (since the sensing signal generator 11 and the sensing signal receiver 12 are integrated together or disposed adjacent to each other, they are regarded as having the same position on the display screen 200).

Figure 3:
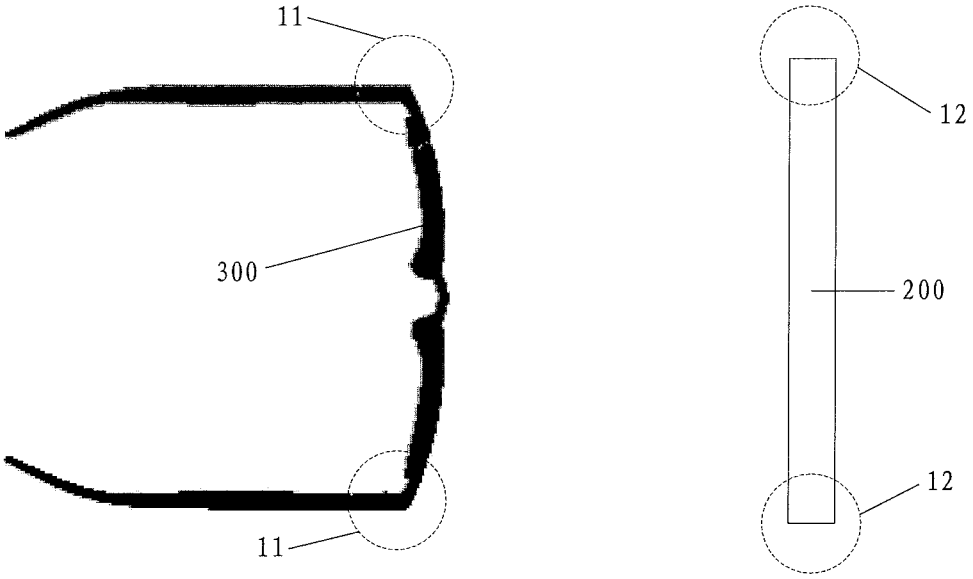
FIG. 3 is a schematic diagram showing a second configuration of a distance measuring device in a display adjusting system according to an embodiment of the invention.

Referring to FIG. 3, the distance measuring device 1 may also include glasses 300, the sensing signal generator 11 may be disposed on the glasses 300, and the sensing signal receiver 12 may be disposed on the display screen 200; alternatively, the sensing signal generator 11 may be disposed on the display screen 200, and the sensing signal receiver 12 may be disposed on the glasses 300.

Taking the sensing signal generator 11 being disposed on the glasses 300 and the sensing signal receiver 12 being disposed on the display screen 200 as an example, as shown in FIG. 3, there may be two sensing signal generators 11 disposed respectively on the left and right sides of the glasses 300, and there may be two sensing signal receivers 12 disposed respectively at the top and bottom ends or the left and right sides of the display screen 200. Sensing signals sent by the sensing signal generators 11 on the glasses 300 are received by the sensing signal receivers 12 on the display screen 200 when transmitted to the display screen 200.

Regarding the configuration where the sensing signal generators 11 and the sensing signal receivers 12 are disposed on the display screen 200 and the glasses 300 respectively, the process of calculating the linear distance from the viewing point to the display screen 200 by the distance measuring device 1, i.e., step S113, may include:

step S1131': calculating a difference between the sending time and the receiving time of the sensing signal and obtaining a duration time of transmission of the sensing signal; and step S1132': multiplying the duration time by the transmission speed of the sensing signal to obtain a transmission distance of the sensing signal, the transmission distance being a travel distance of the sensing signal from the glasses 300 to the display screen 200 or a travels distance from the display screen 200 to the glasses 300. Therefore, the transmission distance is a linear distance between the viewing point (i.e., the position of the glasses 300) and the display screen 200.

To be noted, the linear distance from the viewing point to the display screen 200 calculated through steps S1131' and S1132' is in fact a linear distance between one sensing signal generator 11 and a corresponding sensing signal receiver 12.

Further to be noted, regarding the configuration that all the sensing signal generators 11 and the sensing signal receivers 12 are disposed on the display screen 200, the viewing distance calculating unit 2 may calculate the vertical distance (i.e., the viewing distance) and the viewing angle from the viewing point to the display screen 200 based on values of two linear distances measured by the distance measuring device, known length or width of the display screen 200. Regarding the configuration where the sensing signal generators 11 and the sensing signal receivers 12 are disposed on the display screen 200 and the glasses 300 respectively, the viewing distance calculating unit 2 may calculate the viewing distance and the viewing angle based on values of two linear distances measured by the distance measuring device 1, known length or width of the display screen 200 and a known width of the glasses 300.

In a preferable embodiment, there are at least three sensing signal generators 11, the viewing distance calculating unit 2 may combine values of any two linear distances out of at least three obtained linear distances to calculate a plurality of values of the viewing distance, and average the plurality of values of the viewing distance to obtain an average value. The calculated average value is used as the final value of the viewing distance. This calculating method may improve accuracy of the calculated viewing distance, as compared with the method in which the viewing distance is calculated based on only one set of linear distances, thus, the resolution of the display screen set based on the calculated viewing distance may be more accurate.

Similarly, when there are at least three sensing signal generators 11, the viewing angle calculating unit 4 may combine values of any two linear distances out of at least three obtained linear distances to calculate a plurality of values of the viewing angle, and average the plurality of values of the viewing angle to obtain an average value. The calculated average value is used as the final value of the viewing angle. This calculating method may improve accuracy of the calculated viewing angle, as compared with the method in which the viewing angle is calculated based on only one set of linear distances, thus, the brightness of the display screen set based on the calculated viewing angle may be more accurate.

In the embodiment, the sensing signal for measuring the linear distance between the viewing point and the display screen 200 may be in various forms, such as an acoustic signal or an infrared signal, and accordingly, the distance measuring device 1 may be an acoustic distance measuring device or an infrared distance measuring device.

Taking the distance measuring device 1 being an acoustic distance measuring device as an example, the acoustic signal generated by the sensing signal generator 11 may be a low-frequency signal carrier and coupled with a high-frequency signal. After the generated acoustic signal has been received by the sensing signal receiver 12, the acoustic signal is filtered and denoised to facilitate subsequent calculations of the linear distance. During calculating the linear distance, a sending time and a receiving time of the acoustic signal is determined according to a sending time and a receiving time of the high-frequency signal in the acoustic signal.

To be noted, the display adjusting system and the display adjusting method provided in the embodiment of the invention is not only suitable for portable electronic devices, but also suitable for any display device that needs to reduce its power consumption.

Specific embodiments of the invention are described as above, but the invention is not only limited thereto. Any modifications and changes that can be made readily by an ordinary skilled in the art without departing from this disclosure shall fall within the scope of the invention. Therefore, the scope of the invention should be determined by the appended claims and their equivalents.

What is claimed is:

1. A display adjusting system, comprising:

a distance measuring module configured to measure a viewing distance, the viewing distance being a vertical distance from a viewing point to a display screen; and a resolution adjusting unit connected with the distance measuring module, the resolution adjusting unit being configured to set a matching resolution based on the measured viewing distance and a resolution power of a human's eye under the measured viewing distance and to adjust a resolution of the display screen to the matching resolution, wherein the matching resolution is larger than or equal to the resolution power of the eye under the measured viewing distance.

2. The display adjusting system according to claim 1, wherein the distance measuring module comprises:

a distance measuring device configured to measure a linear distance from the viewing point to the display screen; and a viewing distance calculating unit connected with the distance measuring device and configured to calculate the viewing distance based on the measured linear distance from the viewing point to the display screen.

3. The display adjusting system according to claim 2, wherein the display adjusting system further comprises:

a viewing angle calculating unit connected with the distance measuring device and configured to calculate a viewing angle based on the measured linear distance from the viewing point to the display screen; and a brightness adjusting unit connected with the viewing angle calculating unit, the brightness adjusting unit being configured to set a matching brightness based on the calculated viewing angle and a brightness needed for the human's eye to clearly view a displayed image at the calculated viewing angle and to adjust a brightness of the display screen to the matching brightness.

4. The display adjusting system according to claim 1, wherein the distance measuring device comprises a plurality of sensing signal generators and a plurality of sensing signal receivers, the sensing signal generators and the sensing signal receivers are arranged in one-to-one correspondence, and sensing signals sent by respective sensing signal generators are different from each other.

5. The display adjusting system according to claim 4, wherein the sensing signal generators and the sensing signal receivers are disposed on the display screen, and each of the sensing signal generators is integrated with or disposed adjacent to a corresponding one of the sensing signal receivers.

6. The display adjusting system according to claim 4, wherein the distance measuring device further comprises glasses; and wherein the sensing signal generators are disposed on the glasses and the sensing signal receivers are disposed on the display screen, or the sensing signal generators are disposed on the display screen and the sensing signal receivers are disposed on the glasses.

7. The display adjusting system according to claim 1, wherein the distance measuring device comprises an acoustic distance measuring device or an infrared distance measuring device.

8. A display adjusting method for the display adjusting system according to claim 1, the display adjusting method comprising:

measuring a viewing distance; and setting a matching resolution based on the measured viewing distance and a resolution power of the human's eye under the measured viewing distance, and adjusting the resolution of the display screen to the matching resolution, wherein the matching resolution is larger than or equal to the resolution power of the eye under the measured viewing distance.

9. The display adjusting method according to claim 8, wherein measuring the viewing distance comprising:

measuring a linear distance from a viewing point to the display screen; and calculating the viewing distance based on the measured linear distance from the viewing point to the display screen.

10. The display adjusting method according to claim 9, wherein the display adjusting method further comprises:

calculating a viewing angle based on the measured linear distance from the viewing point to the display screen; and setting a matching brightness based on the calculated viewing angle and a brightness needed for the eye to clearly view a displayed image at the calculated viewing angle, and adjusting a brightness of the display screen to the matching brightness.

11. The display adjusting method according to claim 10, wherein the matching brightness is larger than or equal to the brightness needed for the eye to clearly view the displayed image at the calculated viewing angle.

12. The display adjusting method according to claim 8, wherein the distance measuring module of the display adjusting system comprises a plurality of sensing signal generators and a plurality of sensing signal receivers, the sensing signal generators and the sensing signal receivers are arranged in one-to-one correspondence, and wherein measuring the linear distance from the viewing point to the display screen comprises:

generating and sending a sensing signal by each of the sensing signal generators;

receiving the sensing signal by a corresponding one of the sensing signal receivers; and calculating the linear distance from the viewing point to the display screen based on a sending time and a receiving time of the sensing signal and a transmission speed of the sensing signal.

13. The display adjusting method according to claim 12, wherein the sensing signal generators and the sensing signal receivers are disposed on the display screen, each of the sensing signal generators is integrated with or disposed adjacent to a corresponding one of the sensing signal receivers, and wherein calculating the linear distance from the viewing point to the display screen based on a sending time and a receiving time of the sensing signal and a transmission speed of the sensing signal comprises:

calculating a difference between the sending time and the receiving time of the sensing signal and obtaining a duration time of transmission of the sensing signal;

multiplying the duration time by the transmission speed of the sensing signal to obtain a transmission distance of the sensing signal; and dividing the transmission distance by two to obtain the linear distance from the viewing point to the display screen.

14. The display adjusting method according to claim 12, wherein the distance measuring device further comprises glasses, the sensing signal generators and the sensing signal receivers are disposed on the glasses and the display screen respectively, and wherein calculating the linear distance from the viewing point to the display screen based on a sending time and a receiving time of the sensing signal and a transmission speed of the sensing signal comprises:

calculating a difference between the sending time and the receiving time of the sensing signal and obtaining a duration time of transmission of the sensing signal; and multiplying the duration time by the transmission speed of the sensing signal to obtain the linear distance from the viewing point to the display screen.

* * * * *